US005710389A

United States Patent [19]

Canaday

[11] Patent Number: 5,710,389

[45] Date of Patent: Jan. 20, 1998

[54] BREECH BOLT AND LOCK ASSEMBLY

[75] Inventor: Michael Canaday, King George, Va.

[73] Assignee: The United States of America as represented by the Secretary of the Navy, Washington, D.C.

[21] Appl. No.: 514,884

[22] Filed: Aug. 14, 1995

[51] Int. Cl.[6] ..... F41A 3/56

[52] U.S. Cl. ..... 89/194; 89/180; 89/198

[58] Field of Search ..... 89/190, 191.01, 89/191.02, 192, 193, 194, 195, 196, 197, 198, 199, 180

[56] References Cited

U.S. PATENT DOCUMENTS

| | | | |
|---|---|---|---|
| 1,484,163 | 2/1924 | Vincon | 89/149 |
| 2,167,672 | 8/1939 | Nomar | 89/132 |
| 2,401,903 | 6/1946 | Browning | 42/16 |
| 2,549,162 | 4/1951 | Blacker | 89/176 |
| 3,058,400 | 10/1962 | Hailston et al. | 89/193 |
| 3,363,351 | 1/1968 | Smith | 42/16 |
| 3,859,745 | 1/1975 | Benelli | 42/16 |
| 4,161,836 | 7/1979 | Hayashi | 42/16 |
| 4,270,437 | 6/1981 | Donovan | 89/192 |
| 4,677,897 | 7/1987 | Barrett | 89/166 |
| 4,922,640 | 5/1990 | Toombs | 42/16 |

*Primary Examiner*—Michael J. Carone
*Assistant Examiner*—Matthew J. Lattig
*Attorney, Agent, or Firm*—James B. Bechtel, Esq.

[57] ABSTRACT

A breech bolt and lock assembly for a gas-operated firearm is provided. The assembly is contained within a bolt housing which in turn contains a bolt operating spring and a two-part bolt mechanism. The two-part bolt has a cylindrical outer bolt which encloses the inner bolt and firing pin. A second spring operates the firing pin. During firing, the inertia of the firing pin and inner bolt prevents the sudden rearward movement of the discharging cartridge. There is no other locking of the breech, however, the weight of the inner bolt and pin assembly may be changed to accommodate different propellant loads.

4 Claims, 5 Drawing Sheets

BREECH BOLT AND LOCK ASSEMBLY

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates to breech bolt locks for small firearms and more particularly to locks for gas operated bolts.

BACKGROUND OF THE INVENTION

A variety of breech bolt locks are well known in the conventional art. Typically, breech locks, as used for semi-automatic or automatic weapons having gas-operated bolts, fall in two categories. Each of these categories use the gas of the discharged cartridge to operate the mechanism. In the first type, the cartridge gas operates a mechanism or lever to release the lock on the bolt, thereby allowing the gas to either actively drive the bolt rearward or use the compression of the cartridge to drive the bolt rearward. A second type of bolt lock uses the rearward movement of the firing pin to unlock the bolt mechanism. In the specific application for a spotter rifle on a shoulder-launched rocket weapon, the spotter round comprises a small cartridge located within a larger cartridge. The small cartridge drives the firing pin back, thereby allowing locking balls around the outside of the bolt to be released thereafter allowing the bolt to be driven backward by gas pressure. This type of locking mechanism (for a shoulder-launched multi-purpose assault weapon launcher) requires that the cartridge case have a smaller inner case. The inner case serves as a piston that, upon firing and generating gasses to provide chamber pressure, pushes the firing pin rearward. The firing pin is shaped so that it will hold two rollers in recesses of the in the receiver wall when the pin is fully forward position. As the firing pin is pushed rearward, a smaller cross-section of the firing pin is adjacent to the locking rollers. This change of section allows the rollers to snap inward out of the receiver recesses. With the rollers out of the recesses, the main body of the bolt is free to move rearward, which it does under the force of the remaining chamber gasses. There are certain disadvantages in the prior art system. In particular, the requirement that each round of ammunition have precision machining between inner and outer cartridges and that the receiver and bolt also be built to tight tolerances. A further difficulty is that the ignition reliability for the cartridge is reduced because a large firing pin face comes in contact with the cartridge case as opposed to the more reliable sharpened firing pin. Additionally, the firing pin is subject to increases in friction induced by powder residue leaking between the two cartridge cases, thereby reducing its reliability of the unlocking portion of the mechanism. What is needed is a simple locking mechanism for a bolt of a spotter rifle such that a sharpened, pointed firing pin mechanism may be used. Additionally, there should be no leakage of powder residue into the pin area or at least reduced leakage. Also, an improved bolt should be capable of firing cartridges having a unitary construction, that is, a cartridge without the smaller inner cartridge.

SUMMARY OF THE INVENTION

Accordingly, an object of the present invention is to provide a breech bolt and lock assembly adaptable for use with a unitary cartridge design.

It is another object of the invention to provide a breech bolt and lock assembly which can operate reliably with wide machining tolerances.

It is a further object of the invention to provide a breech bolt and lock assembly having an inertial locking mechanism.

In accordance with these and other objects, a breech bolt and lock assembly is provided comprising a weighted bolt having a small interior firing pin and a spring assembly driving the bolt into the forward chamber and position. The face of the breech bolt is approximately the same diameter as the rear of the spotter round.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
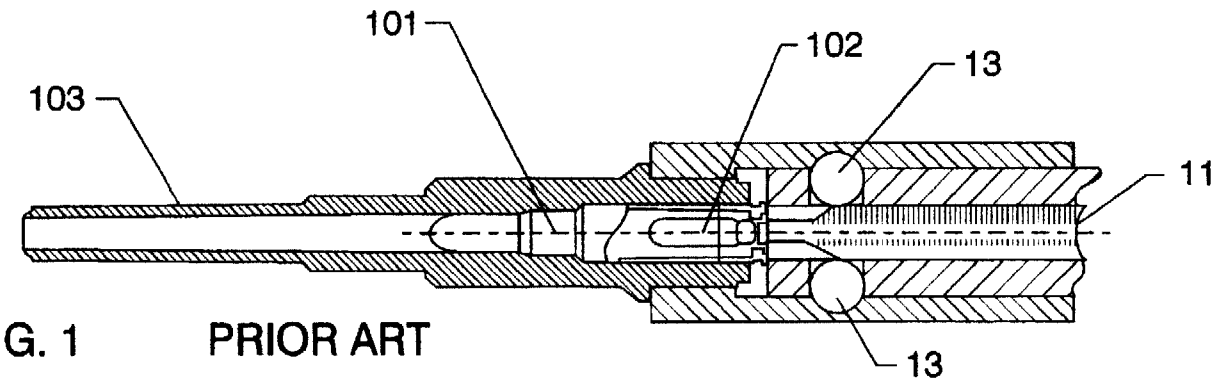
FIG. 1 PRIOR ART
FIG. 1 is a cross-sectional view of a typical prior art breech locking mechanism for a spotter rifle with the bolt in the forward position ready for firing.
Figure 2:
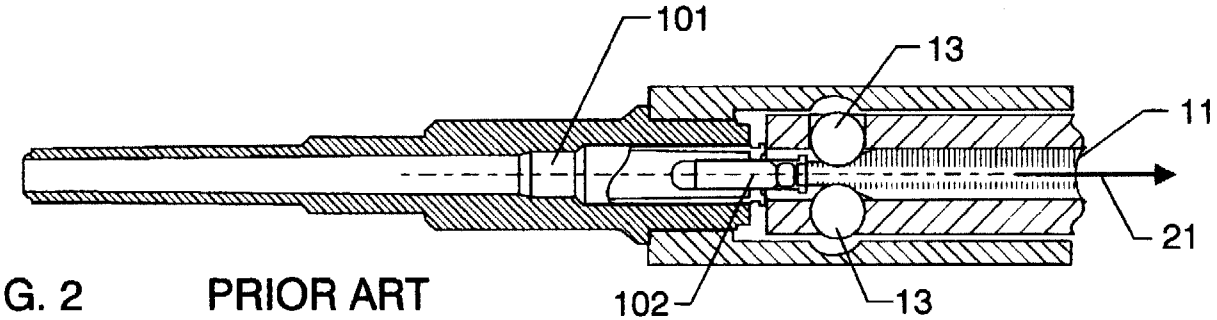
FIG. 2 PRIOR ART
FIG. 2 is a cross-sectional view showing the prior art locking mechanism with the inner cartridge driving the firing pin aft to allow unlocking.
Figure 3:
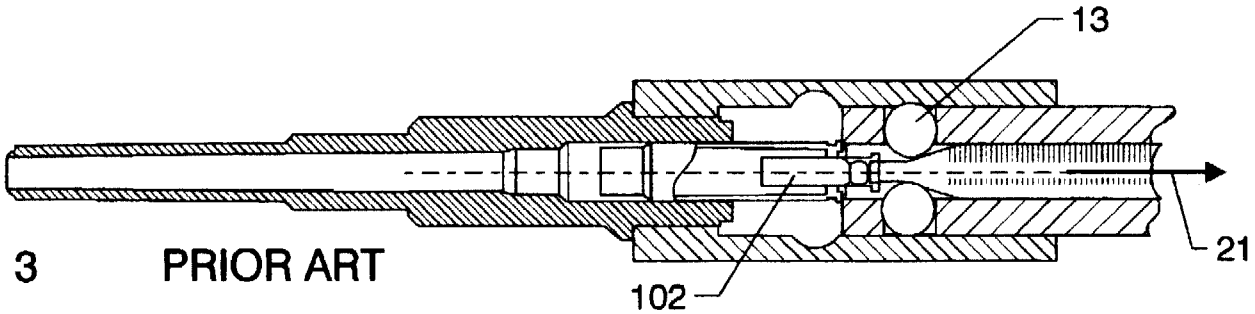
FIG. 3 PRIOR ART
FIG. 3 is a cross-sectional view showing the prior art locking mechanism with the cartridge extracted and ready for ejecting.

Referring now to FIGS. 1 through 3, operation of a bolt mechanism for a rocket launcher spotter rifle currently in use with the U.S. Armed Forces can be seen. The spotter dual cartridge 101 is a reduced-propellant cartridge modified to provide matching ballistics to a particular shoulder-launched weapon. The reduced propellant charge requires an inner cartridge 102 which contains the primer and reduced propellant charge. The cartridge 101 is shown in the firing position in a spotter rifle barrel 103 for reference.

With the bolt in the forward or firing position, as shown in FIG. 1, the firing pin 11 rests against the inner cartridge 102. The bolt locks 13 are locked by the position of the firing pin (11 holding the balls in detents in the bolt housing).

After firing, as shown in FIG. 2, the smaller inner cartridge 102 is driven backward by gas pressure and slides out of the main cartridge 101, thereby pushing the firing pin 11 rearward as depicted by arrow 21. The rearward movement of the firing pin 11 allows the bolt locks 13 to drop out of the detents, thereby unlocking the bolt.

Thereafter, as shown in FIG. 3, the entire bolt assembly slides rearward, as depicted by arrow 21, allowing ejection of the spent cartridge.

Figure 4:
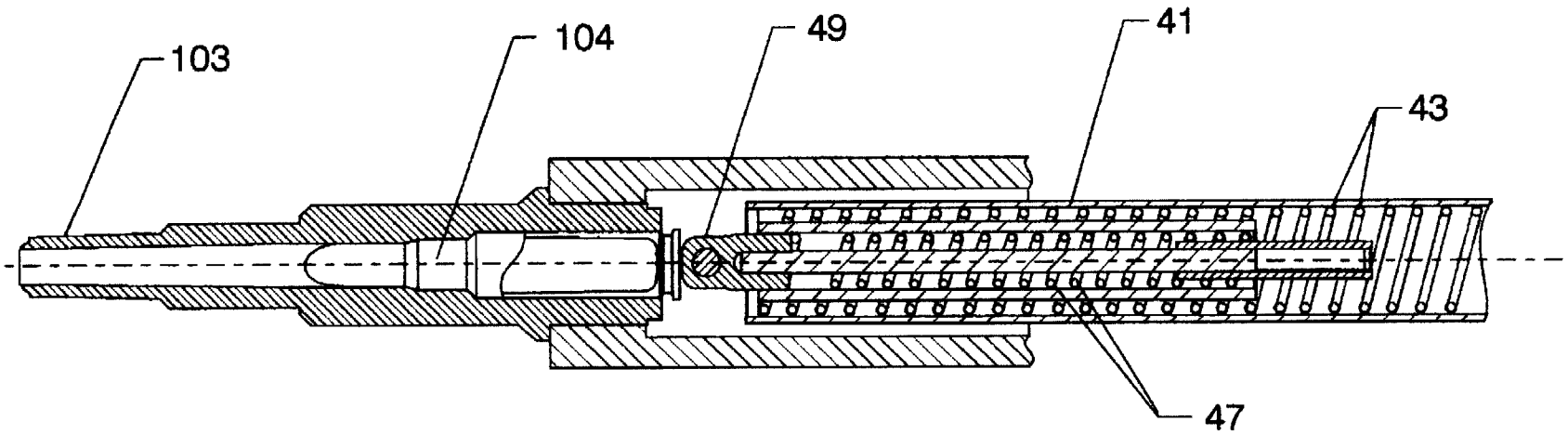
FIG. 4 is a cross-sectional view showing the bolt of the present invention in firing position.

The present invention, as depicted in FIG. 4, has no ball locks to hold the bolt in position. The bolt and lock assembly comprise a two-part bolt assembly having a bolt housing 41 having a hollow cylindrical shape. The bolt housing 41 contains a first spring 43 which operates the bolt in conjunction with the gas operation. The cartridge 104 (a conventional single cartridge in this illustration) is shown chambered in the barrel 103 for reference. The weight of the firing pin 49 provides an inertial resistance to movement which holds the cartridge 101 in position for proper discharge. (There is no mechanical locking of the bolt, only the "inertial lock" provided by the mass of firing pin 49). The firing pin 49 is urged in the forward direction by a second spring which serves as both a firing pin spring and as an initial absorber spring to decrease the impact acceleration of the bolt.

Figure 5:
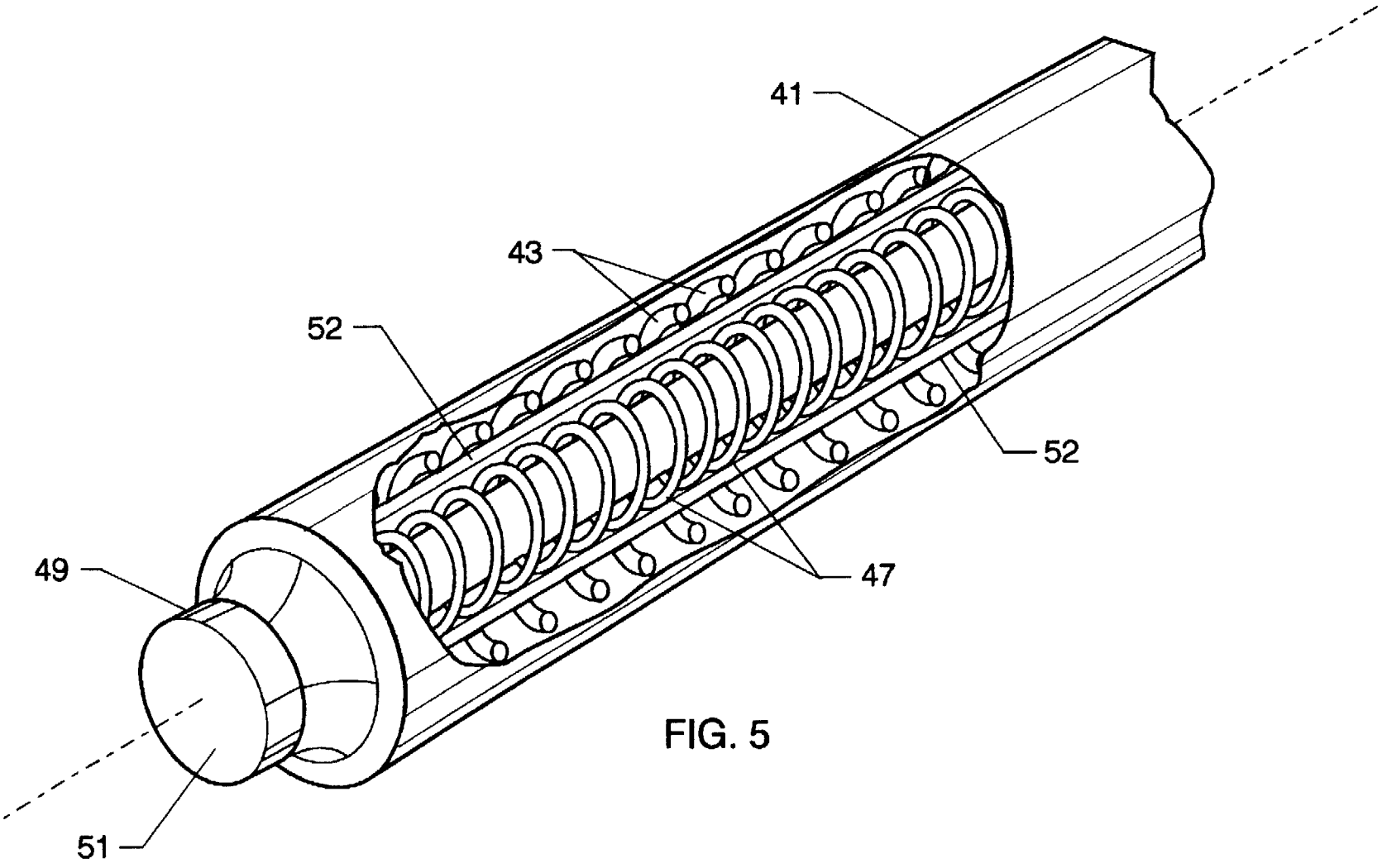
FIG. 5 is a perspective view of the breech bolt and lock assembly with a cutaway showing interior details.

The details of the bolt construction may be seen by reference to FIG. 5. The bolt housing 41 contains the bolt operating spring 43 which urges the bolt and firing pin assembly toward the forward or firing position (to the left as depicted). The outer cylindrical bolt 52 is slideably positioned within the bolt housing 41 and engages the spring 43 using a collar on the firing pin or left end. The firing pin 49 has a small pointed center 51 which aids in igniting the cartridge primer. The firing pin 49 is attached to a smaller shaft forming a pin and inner bolt mechanism which slideably engages the outer cylindrical bolt. The second spring 47 provides the dual function of driving the firing pin 49 toward the firing position and absorbing the initial impact of the discharging cartridge.

Figure 6:
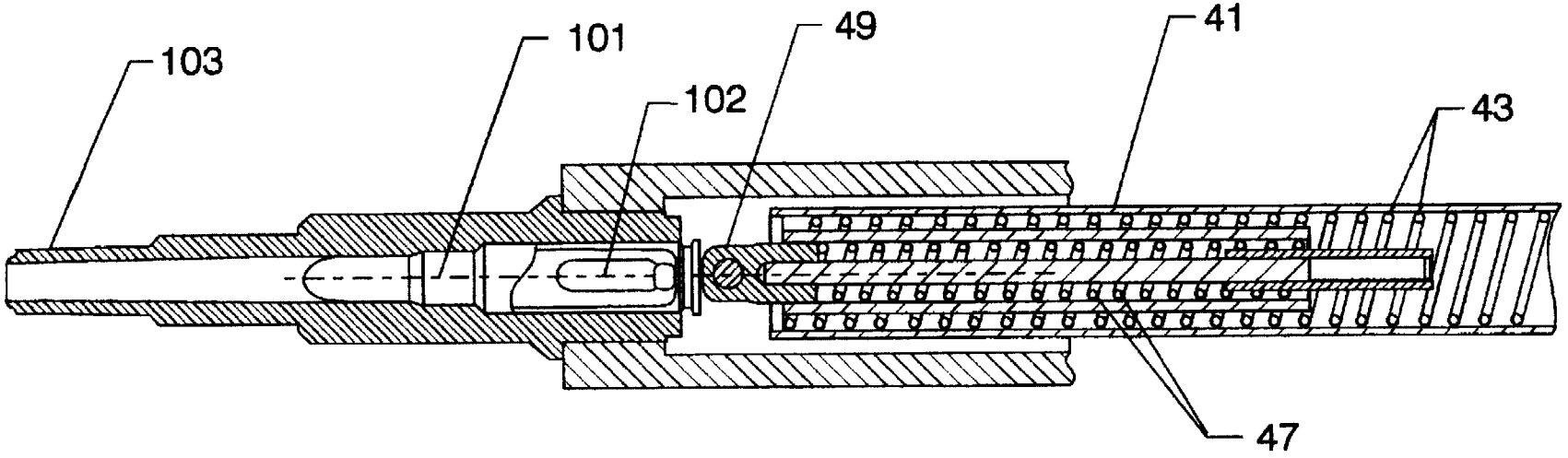
FIG. 6 is a cross-sectional view showing the breech bolt and lock assembly with a typical dual cartridge round.

Referring now to FIG. 6, the breech bolt and lock assembly is shown using the modified dual cartridge 101 the dual cartridge being modified to include an inner cartridge 102 to hold the reduced charge as (required by spotter rifles in current use). The cartridge 101 is shown in firing position in the barrel 103. The firing pin 49 is in place ready to discharge the cartridge. The housing 41 and spring 43 and 47 are shown for reference. As can be appreciated, either type of cartridge may be fired using the new bolt and lock assembly. Although the more expensive and complex dual cartridge is not required, existing stocks will operate the new bolt.

Figure 7:
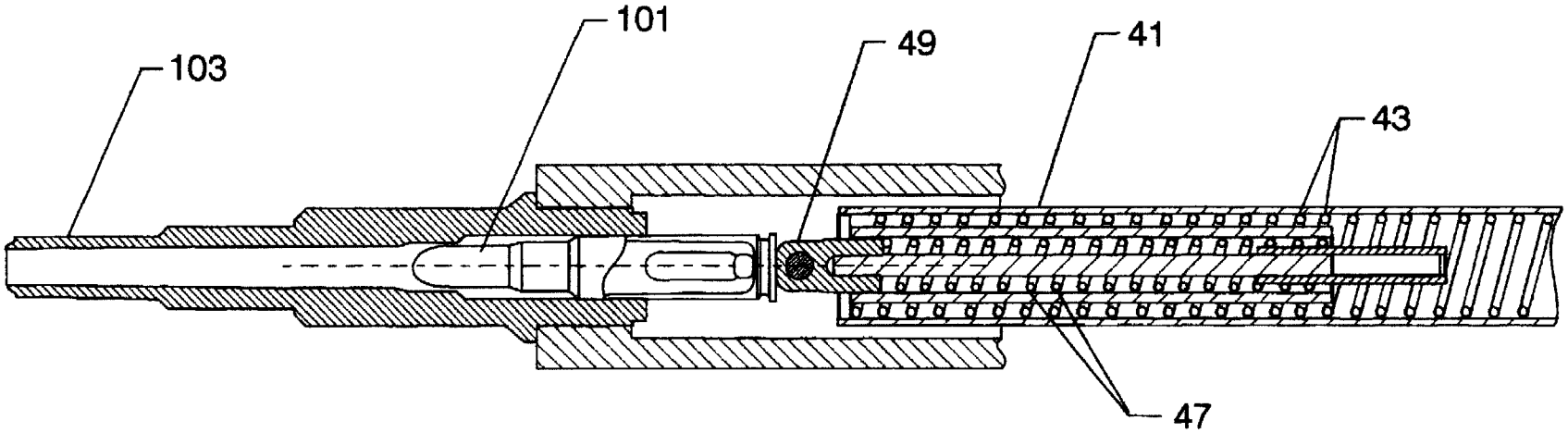
FIG. 7 is a cross-sectional view showing the extraction of a typical dual cartridge round.

Referring now to FIG. 7, the breech bolt and lock assembly is shown during extraction of a spent cartridge using the dual cartridge style round. In this case, the smaller inner cartridge remains in place in the larger cartridge 101 as it leaves barrel 103. Both cartridges acting together drive firing pin 49 rearward and, thereafter, drive the remaining bolt components rearward compressing springs 43 and 47.

The novel features and advantages of the invention are numerous. The breech bolt and locking mechanism has a reduced parts count, has fewer operating parts, has no engaging locking device and as a result is less expensive and more reliable. Further, the new bolt and lock assembly can operate with any type of cartridge. There is no requirement for the expensive dual cartridge design currently in use.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A breech bolt and lock assembly for a gas-operated firearm comprising:

a bolt housing having a cylindrical shape;

a first spring contained within said bolt housing;

a two-part bolt assembly having an outer cylindrical bolt slideably positioned within said bolt housing and operated by said first spring and having an inner bolt and weighted pin mechanism slideably positioned within said outer cylindrical bolt and providing an inertial bolt lock; and a second spring positioned within said outer cylindrical bolt and enclosing said inner bolt and weighted pin mechanism and further urging said inner bolt and pin assembly toward the firing position.

2. A breech bolt assembly for a gas-operated firearm as in claim 1 wherein said inner bolt and firing pin mechanism comprises a weighted cylindrical firing pin having a pointed center for engaging a cartridge.

3. A breech bolt and lock assembly for a gas-operated firearm comprising:

a housing;

an outer bolt contained within said housing;

a bolt-operating spring positioned within said housing and engaging said bolt; and a weighted firing pin attached to an inner bolt adapted for use with both dual spotter cartridges and reduced propellant single spotter cartridges interchangeably.

4. A breech bolt and lock assembly for a gas-operated firearm as in claim 3 wherein said weighted firing pin has a pointed center for igniting a cartridge primer.

* * * * *